US008009180B2

(12) United States Patent
Nose et al.

(10) Patent No.: US 8,009,180 B2
(45) Date of Patent: Aug. 30, 2011

(54) DISPLAY APPARATUS CONTAINING CONTROLLER DRIVER WITH CORRECTING CIRCUIT AND METHOD OF DRIVING DISPLAY PANEL

(75) Inventors: Takashi Nose, Kanagawa (JP); Hirobumi Furihata, Kanagawa (JP)

(73) Assignee: Renesas Electornics Corporation, Kawasaki, Kanagawa (JP)

( * ) Notice: Subject to any disclaimer, the term of this patent is extended or adjusted under 35 U.S.C. 154(b) by 956 days.

(21) Appl. No.: 11/515,037

(22) Filed: Sep. 5, 2006

(65) Prior Publication Data

US 2007/0013979 A1 Jan. 18, 2007

(30) Foreign Application Priority Data

Sep. 6, 2005 (JP) ..... 2005-257727

(51) Int. Cl.
*G09G 5/10* (2006.01)

(52) U.S. Cl. ..... 345/690; 345/89; 348/674; 348/675; 358/519; 358/521

(58) Field of Classification Search ..... 345/601–605, 345/690, 89, 698, 3.3; 348/254, 441–698; 358/519, 521
See application file for complete search history.

(56) References Cited

U.S. PATENT DOCUMENTS

2002/0057374 A1* 5/2002 Suzuki ..... 348/674

FOREIGN PATENT DOCUMENTS

| | | | |
|---|---|---|---|
| JP | P2000-184236 | A | 6/2000 |
| JP | P2001-103504 | A | 4/2001 |
| JP | P2001-238227 | A | 8/2001 |
| JP | P2004-212598 | A | 7/2004 |
| JP | 2004-350115 | | 12/2004 |

OTHER PUBLICATIONS

Chinese Office Action dated Sep. 19, 2008 with English-Language Translation.

* cited by examiner

*Primary Examiner* — Lun-Yi Lao
*Assistant Examiner* — Kelly Hegarty
(74) *Attorney, Agent, or Firm* — McGinn IP Law Group, PLLC

(57) ABSTRACT

A display apparatus includes a display panel; a correcting circuit configured to carry out gamma correction on input gradation data in response to correction data which specifies a shape of a gamma curve to generate output gradation data; and a driving circuit configured to drive the display panel in response to the output gradation data from the correcting circuit. The correcting circuit carries out approximation calculation for the gamma correction based on the input gradation data by using a correction calculation equation whose coefficients are determined based on the correction data, and the correction calculation equation is switched based on a value of the input gradation data and a value of the correction data.

17 Claims, 6 Drawing Sheets

DISPLAY APPARATUS CONTAINING CONTROLLER DRIVER WITH CORRECTING CIRCUIT AND METHOD OF DRIVING DISPLAY PANEL

BACKGROUND OF THE INVENTION

1. Field of the Invention

The present invention relates to a display apparatus and a method of driving a display panel, and more specifically, to a technique for correcting gradation data to adjust gradation of data displayed on a display panel.

2. Description of the Related Art

In a liquid crystal display, gamma correction is generally carried out, in which the correspondence between gradation data externally supplied and a driving signal for driving a display apparatus is corrected in accordance with the voltage-transmittance characteristic (V-T characteristic) of a liquid crystal panel. The V-T characteristic of the liquid crystal panel is nonlinear. Accordingly, in order to display an original image with a proper color tone, a nonlinear drive voltage for the gradation data needs to be generated through gamma correction. Further, to improve the color tone of the display image, the gamma correction may be carried out by using different gamma values for R (red), G (green), and B (blue), respectively. Since the voltage-transmittance characteristic of the liquid crystal panel differs among R (red), G (green), and B (blue), it is desirable that the gamma correction is carried out by using gamma values for the respective colors in order to improve the color tone of the display image.

In one of methods of achieving the gamma correction of the liquid crystal panel, data processing is carried out on gradation data. In this gamma correction, the data processing is carried out on input gradation data $D_{IN}$ in accordance with the following equation (1) and output gradation data $D_{OUT}$ is generated:

$$D_{OUT}=D_{OUT}^{MAX}(D_{IN}/D_{IN}^{MAX})^{\gamma} \quad (1)$$

where $D_{IN}^{MAX}$ is the maximum value of the input gradation data and $D_{OUT}^{MAX}$ is the maximum value of the output gradation data. The drive voltage signal for driving a signal line is generated in accordance with the generated output gradation data $D_{OUT}$.

What is concerned with the gamma correction through the data processing is that the data processing includes repetitive multiplication such as power multiplication, as could be understood from the equation (1). Since a circuit becomes complicated to exactly perform power multiplication, a problem is caused when such a circuit is mounted on a liquid crystal driver. A CPU (Central Processing Unit) has excellent arithmetic capability, and the power multiplication can be exactly carried out through a combination of logarithmic calculation, multiplication, and exponential calculation by the CPU. For example, Japanese Laid Open Patent Application (JP-P2001-103504A) discloses gamma correction which is achieved through combination of the logarithmic calculation, multiplication, and exponential calculation. However, it is not preferable from the viewpoint of hardware reduction to mount the circuit for exact gamma correction on the liquid crystal driver.

In a simple method of accomplishing the gamma correction, a look-up table (LUT) is used in which the correspondence between input gradation data and output gradation data is described or defined in accordance with the equation (1). Thus, the gamma correction can be achieved without directly calculating the power multiplication. In Japanese Laid Open Patent Applications (JP-P2001-238227A and JP-A-Heisei 7-056545), the technique in which LUTs are provided for R (red), G (green), and B (blue), respectively, so that the gamma correction can be carried out for every gamma value for every color.

When the LUT is used for the gamma correction, increase in the size of LUT (or the number of LUTs) is required to perform the gamma correction to different gamma values. For example, if the gamma correction is carried out for each of R, G, and B, and for 256 kinds of gamma values by using an LUT in which the input gradation data is 6-bit data and the output gradation data is 8-bit data, the LUT of 393216 (=64×8×3×256) bits is required. This makes it difficult to incorporate the gamma correction circuit in the liquid crystal driver.

Japanese Laid Open Patent Application (JP-A-Heisei 9-288468) discloses a technique for carrying out the gamma correction to a plurality of gamma values while keeping the size of LUT small. In this conventional example, a rewritable LUT is provided in the liquid crystal display apparatus. Data to be held in the LUT is calculated by a CPU based on calculation data stored in an EEPROM and then transferred from the CPU to the LUT. Japanese Laid Open Patent Application (JP-P2004-212598A) also discloses a similar technique. In this conventional example, LUT data is generated by a brightness distribution determining circuit and the LUT data is transferred to the LUT.

Japanese Laid open Patent Application (JP-P2000-184236A) discloses a technique in which increase in the circuit size is suppressed by directly using the LUT not for the generation of output gradation data (the correspondence between the input gradation data and post-correction gradation data is described in the LUT) but for calculation of a parameter for broken line approximation of the gamma characteristic. In this conventional example, when a gamma value $\gamma 1$ (a gamma value for a cathode-ray tube) for gamma correction carried out upon generation of input video data is given externally, a liquid crystal display apparatus generates broken line information for achieving the gamma correction on this input video data based on another gamma value $\gamma 2$ (a gamma value for a liquid crystal display apparatus) by way of the broken line approximation. When the input video data is given, this liquid crystal display apparatus calculates the post-correction gradation data through the broken line approximation defined based on the broken line information.

One of demands on the liquid crystal display apparatus is instantly switching a gamma curve, that is, instantly switching a gamma value of gamma correction. For mobile terminals such as notebook type PCs, PDAs (Personal Digital Assistants), and cellular phones, due to their various possible usage environments, there is a demand to change the visibility of the liquid crystal panel in accordance with the environment. For example, in a liquid crystal display that uses a semi-transmissive LCD, an image is displayed mainly in a reflection mode when the intensity of external light is strong and mainly in a transparent mode when the intensity of external light is weak. Between the reflection mode and the transparent mode, the gamma value of the liquid crystal panel is different. Thus, the liquid crystal panel is viewed very differently depending on the intensity of external light. Therefore, the capability of instantly switching a gamma value allows a great improvement in the viewability of the liquid crystal display.

Another of demands is accurately performing the gamma correction with the simplest circuit. The equation (1) is based on the physical and physiological structure of human eyes. Therefore, a large difference of a value obtained from the exact equation (1) from the post-correction gradation data brings about an unnatural feeling of an image in the human vision. Therefore, ideally, it is desirable that the post-correction gradation data is coincident with the value obtained from an exact equation. However, the use of a complicated circuit for accurate gamma correction disadvantageously results in an increase in the cost of the liquid crystal driver. Therefore, accurate gamma correction by a simple circuit is one of major demands on the liquid crystal driver.

However, the conventional techniques fail to simultaneously satisfy these demands. For example, in the techniques described in Japanese Laid Open Patent Applications (JP-A-Heisei 9-288468 and JP-P2004-21259A), it is necessary to rewrite data to be stored in the LUT to the LUT for switching the gamma values of gamma correction. However, the data in the LUT has a considerable size. This means that it is difficult to instantly switch the gamma value of gamma correction.

On the other hand, as described in Japanese Laid Open Patent Application (JP-P2000-184286A), the method using broken line approximation suffers from difficulty in achieving accurate gamma correction.

SUMMARY OF THE INVENTION

As described above, it is demanded to provide a technique in which accurate gamma correction can be achieved while a gamma curve used for the gamma correction can be instantly switched.

In an aspect of the present invention, a display apparatus includes a display panel; a correcting circuit configured to carry out gamma correction on input gradation data in response to correction data which specifies a shape of a gamma curve to generate output gradation data; and a driving circuit configured to drive the display panel in response to the output gradation data from the correcting circuit. The correcting circuit carries out approximation calculation for the gamma correction based on the input gradation data by using a correction calculation equation whose coefficients are determined based on the correction data, and the correction calculation equation is switched based on a value of the input gradation data and a value of the correction data.

Here, the correction calculation equation is selected from among a plurality of calculation equations. A first calculation equation of the plurality of calculation equations has a term proportional to $D_{IN}^{n1}$ ($D_{IN}$ is the input gradation data and $0<n1<1$) without having a term proportional to $D_{IN}^{n2}$ ($n2>1$), and a second calculation equation of the plurality of calculation equations has a term proportional to $D_{IN}^{n2}$ without having a term proportional to $D_{IN}^{n1}$. In this case, the n1 may be ½, and the n2 may be 2.

Also, the correction data may be determined for a gamma value for the gamma correction to be less than one, and when the input gradation data is smaller than a predetermined value, the first calculation equation may be selected as the correction calculation equation.

Also, the correction data is determined for the gamma value for the gamma correction to exceed one, and the second calculation equation is selected as the correction calculation equation when the input gradation data is smaller than the predetermined value or when the input gradation data is larger than the predetermined value.

Also, the first calculation equation may be defined such that the output gradation data calculated through the gamma correction from the first calculation equation and the output gradation data calculated from an exact equation for the gamma correction are coincident with each other when the input gradation data is a value of a first value range. The second calculation equation may be defined such that the output gradation data calculated through the gamma correction from the second calculation equation and the output gradation data calculated from the exact equation of the gamma correction are coincident with each other, when the input gradation data is a value of a second value range. The first value range may be smaller than the second value range.

Also, the correction data may be externally supplied to the display apparatus. In this case, the display apparatus may further include a correction data storage section configured to receive and store the correction data supplied externally, and to transfer the stored correction data to the correcting circuit.

Also, the correction data may contain correction point data CP0 to CP5. If the input gradation data is $D_{IN}$, the output gradation data is $D_{OUT}$ and an intermediate data value $D_{IN}^{Center}$ is defined by a following equation (1) by using the permissible maximum value $D_{IN}^{MAX}$ of the input gradation data:

$$D_{IN}^{Center}=D_{IN}^{MAX}/2 \tag{1}$$

(1) when the correction point data CP0 to CP5 are determined for the input gradation data $D_{IN}$ to be smaller than the intermediate data value $D_{IN}^{Center}$ and for the gamma value of the gamma correction to be less than one, the output gradation data $D_{OUT}$ is calculated from the following equation (2a):

$$D_{OUT}=2(CP1-CP0)PD_{INS}/K^2+(CP3-CP0)D_{INS}/K+CP0 \tag{2a}$$

(2) when the correction point data CP0 to CP5 are determined for the input gradation data $D_{IN}$ to be smaller than the intermediate data value $D_{IN}^{Center}$ and for the gamma value of the gamma correction to exceed one, the output gradation data $D_{OUT}$ is calculated from the following equation (2b):

$$D_{OUT}=2(CP1-CP0)ND_{INS}/K^2+(CP3-CP0)D_{INS}/K+CP0 \tag{2b}$$

(3) when the input gradation data $D_{IN}$ is larger than the intermediate data value $D_{IN}^{Center}$, the output gradation data $D_{OUT}$ is calculated from the following equation (2c):

$$D_{OUT}=2(CP4-CP2)ND_{INS}/K^2+(CP5-CP2)D_{INS}/K+CP2 \tag{2c}$$

where when a parameter R is defined by the following equation:

$$R=K^{1/2}\cdot D_{INS}^{1/2},$$

said K, DINS, PDINS, and NDINS take values defined by the following equations:

$$K=(D_{IN}^{MAX}+1)/2,$$

$$D_{INS}=D_{IN} \text{ (in case of } D_{IN}<D_{IN}^{Center})$$

$$D_{INS}=D_{IN}+1-K \text{ (in case of } DIN>D_{IN}^{Center})$$

$$PD_{INS}=(K-R)\cdot R$$

$$ND_{INS}=(K-D_{INS})\cdot D_{INS}.$$

Also, the correction point data CP0 to CP5 are calculated: (1) from the following equation (3a) when the gamma value γ of the gamma correction is smaller than one, $$CP0$$

$$CP1=(4\text{Gamma}[K/4]-\text{Gamma}[K])/2$$

$$CP2=\text{Gamma}[K-1]$$

$$CP3=\text{Gamma}[K]$$

$$CP4=2\text{Gamma}[(D_{IN}^{MAX}+K-1)/2]-D_{OUT}^{MAX}$$

$$CP5=D_{OUT}^{MAX} \tag{3a}$$

and (2) from the following equation (3b) when the gamma value γ exceeds one:

$$CP0$$

$$CP1=2\text{Gamma}[K/2]-\text{Gamma}[K]$$

$$CP2=\text{Gamma}[K-1]$$

$$CP3=\text{Gamma}[K]$$

$$CP4=2\text{Gamma}[(D_{IN}^{MAX}+K-1)/2]-D_{OUT}^{MAX}$$

$$CP5=D_{OUT}^{MAX} \tag{3b}$$

where Gamma[x] is a function defined by the following equation when $D_{OUT}^{MAX}$ is a maximum value of the output gradation data:

$$\text{Gamma}[x]=D_{OUT}^{MAX}(x/D_{IN}^{MAX})^{\gamma} \tag{4}$$

Also, the correcting circuit may include an order switching circuit having a function to generate a first data value which depends on $D_{IN}^{n1}$ ($D_{IN}$ is the input gradation data and 0<n1<1) and a second data value which depends on $D_{IN}^{n2}$ (n2>1), and configured to output one of the first data value and the second data value; and an output gradation data calculating circuit configured to use the one of the first and second data values as a variable, and to generate the output gradation data by using a calculation equation whose coefficients are determined from correction data which specifies a shape of a gamma curve for the gamma correction.

In another aspect of the present invention, a controller driver includes a correcting circuit configured to carry out gamma correction on input gradation data in response to correction data which specifies a shape of a gamma curve; and a driving circuit configured to drive a display panel in response to output gradation data which is outputted from the correcting circuit. The correcting circuit uses the input gradation data as a variable and carries out approximation calculation of the gamma correction by using a correction calculation equation whose coefficients are determined based on the correction data, and the correction calculation equation is switched in response to a value of the input gradation data and a value of the correction data.

Also, the correction calculation equation may be selected from among a plurality of calculation equations. A first calculation equation of the plurality of calculation equations may have a term proportional to $D_{IN}^{n1}$ ($D_{IN}$ is the input gradation data and 0<n1<1) without having a term proportional to $D_{IN}^{n2}$ (n2>1), and a second calculation equation of the plurality of calculation equations may have a term proportional to $D_{IN}^{n2}$ without having a term proportional to $D_{IN}^{n1}$.

Also, the correction data may be determined for the gamma value of the gamma correction to be less than one, and when the input gradation data is smaller than a predetermined value, the first calculation equation may be selected as the correction calculation equation.

Also, the controller driver may further include a correction data storage section configured to receive the correction data from outside the controller driver to store therein the received correction data, and to transfer the stored correction data to the correcting circuit.

Also, the correcting circuit may include an order switching circuit having a function to generate a first data value which depends on $D_{IN}^{n1}$ ($D_{IN}$ is the input gradation data and 0<n1<1) and a second data value which depends on $D_{IN}^{n2}$ (n2>1) in response to the input gradation data, and configured to output one of the first and second data values; and an output gradation data calculating circuit configured to use the one data value outputted from the order switching circuit as a variable and to generate the output gradation data by using a calculation equation whose coefficients are determined from the correction data which specifies a shape of gamma curve for the gamma correction.

In another aspect of the present invention, an approximation calculation correcting circuit includes an order switching circuit having a function to generate a first data value which depends on $D_{IN}^{n1}$ ($D_{IN}$ is input gradation data and 0<n1<1) and a second data value which depends on $D_{IN}^{n2}$ (n2>1) in response to the input gradation data, and configured to output one of the first and second data values; and an output gradation data calculating circuit configured to use the one data value outputted from the order switching circuit as a variable and to generate the output gradation data by using a calculation equation whose coefficients are determined from the correction data which specifies a shape of gamma curve for the gamma correction.

Also, the order switching circuit may include a first data value calculating circuit configured to generate the first data value with no relation to the correction data in response to the input gradation data; and a second data value calculating circuit configured to generate the second data value with no relation to the correction data in response to the input gradation data.

Also, the first data value calculating circuit may include a first combination circuit configured to generate the first data value, and the second data value calculating circuit may include a second combination circuit configured to generate the second data value.

Also, the order switching circuit may select the one data value in response to the correction data.

Also, the order switching circuit may select as the one data value, the first data value when the correction data is determined such that the gamma value for the gamma correction is less than one, and the second data value when the correction data is determined such that the gamma value for the gamma correction exceeds one.

Also, in another aspect of the present invention, a method of driving a display panel, is achieved by generating output gradation data from input gradation data by carrying out approximation of gamma correction on input gradation data by using a correction calculation equation whose coefficients are determined based on correction data which specifies a shape of a gamma curve; and by driving a display panel in response to the output gradation data. The correction calculation equation is selected from among a plurality of calculation equations based on a value of the input gradation data and a value of the correction data.

DESCRIPTION OF THE PREFERRED EMBODIMENTS

Hereinafter, a display apparatus having a controller driver with a correcting circuit of the present invention will be described in detail with reference to the attached drawings.

Figure 1:
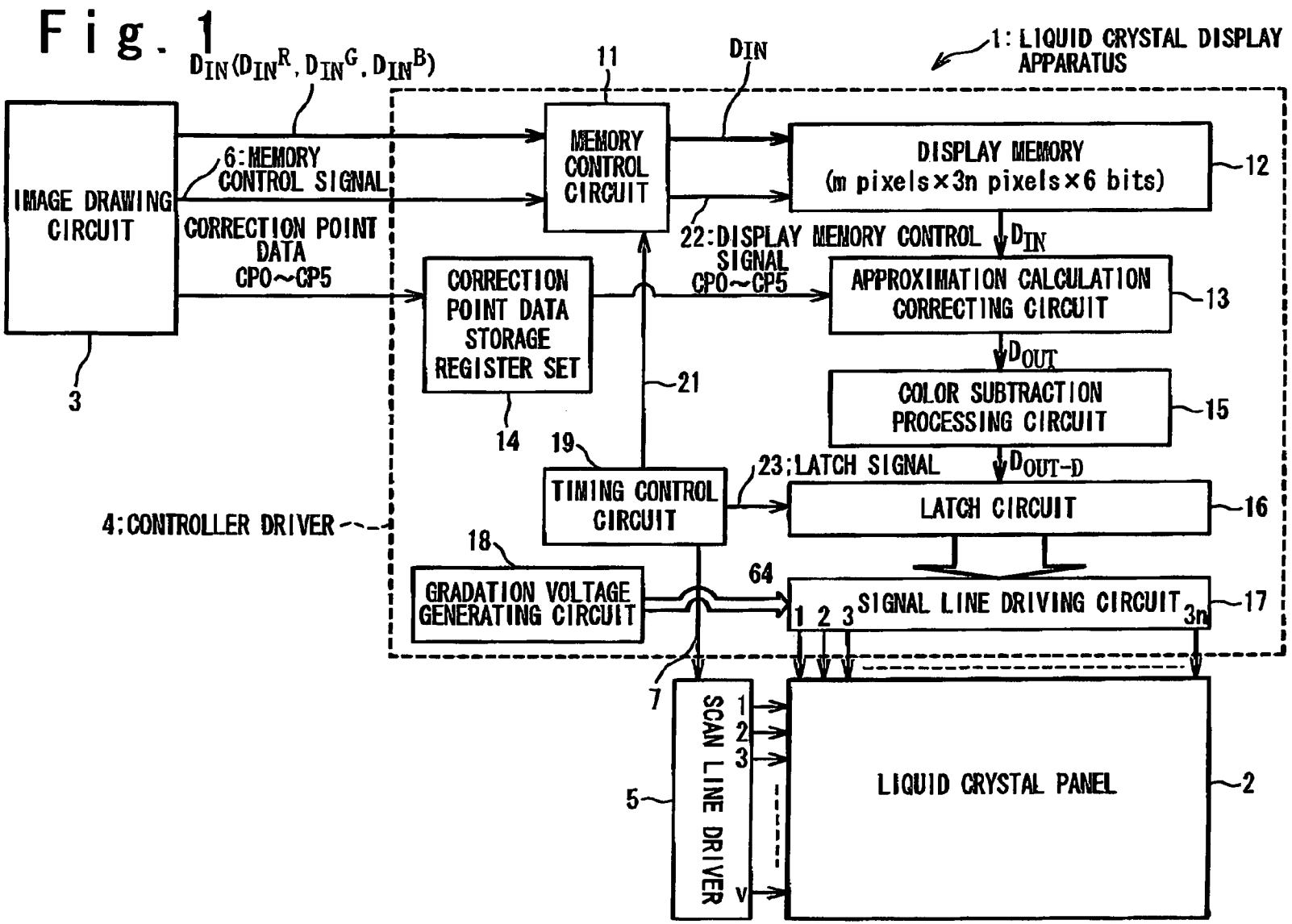
FIG. 1 is a block diagram showing the configuration of a liquid crystal display apparatus according to an embodiment of the present invention.

FIG. 1 is a block diagram showing the configuration of a liquid crystal display apparatus 1 according to an embodiment of the present invention. The liquid crystal display apparatus 1 is provided with a liquid crystal panel 2, a controller driver 4, and a scan line driver 5, and is configured to display images on the liquid crystal panel 2 in response to various data and control signals transmitted from an image drawing circuit 3. More specifically, the image drawing circuit 3 generates input gradation data $D_{IN}$ corresponding to an image to be displayed on the liquid crystal panel 2. In this embodiment, the input gradation data $D_{IN}$ is 6-bit data. Hereinafter, the input gradation data $D_{IN}$ corresponding to an R (red) pixel of the liquid crystal panel 2 is indicated as input gradation data $D_{IN}^R$. Similarly, the input gradation data $D_{IN}$ corresponding to G (green) and B (blue) pixels may be indicated as input gradation data $D_{IN}^G$ and input gradation data $D_{IN}^B$, respectively.

Further, the image drawing circuit 3 generates a memory control signal 6 used for control of the controller driver 4 and correction point data $CP_0$ to $CP_5$ and supplies them to the controller driver 4. As described later, the correction point data $CP_0$ to $CP_5$ are data for determining the shape of a gamma curve of gamma correction carried out by the controller driver 4. Since the gamma values of the liquid crystal panel 2 are different from each other for every color (that is, different for R, G, and B), the correction point data $CP_0$ to $CP_5$ are selected so as to differ for R, G, and B. If necessary, the correction point data corresponding to R, G, and B are indicated as R-correction point data $CP_0^R$ to $CP_5^R$, G-correction point data $CP_0^G$ to $CP_5^G$, and B-correction point data $CP_0^B$ to $CP_5^B$, respectively. As the image drawing circuit 3, for example, a CPU (Central Processing Unit) or a DSP (Digital Signal Processor) is used.

The liquid crystal panel 2 is provided with m scan lines (gate lines), 3n signal lines (source lines); and m by 3n pixels provided at positions where these lines intersect with each other (m and n are natural numbers).

The controller driver 4 receives the input gradation data $D_{IN}$ from the image drawing circuit 3, and drives the signal lines (source lines) of the liquid crystal panel 2 in response to the input gradation data $D_{IN}$. The controller driver 4 has a function of generating a scan line driver control signal 7 to control the scan line driver 5. The controller driver 4 is integrated on a semiconductor chip separately from the image drawing circuit 3 which is integrated on a different integrated circuit. This is important in that the gradation data is transferred from the image drawing circuit 3 to the controller driver 4 via wirings located outside the chip. For example, as in conventional technique, transferring data stored in an LUT for the gamma correction from the image drawing circuit 3 to the controller driver 4 disadvantageously increases the time required for the data transfer. As described in detail later, the liquid crystal display apparatus in this embodiment transfers not the data in the LUT but the correction point data CP0 to CP5 from the image drawing circuit 3 to the controller driver 4 to suppress the volume of data to be transferred. Thus, the gamma curve used for the gamma correction can be instantly switched.

The scan line driver 5 drives the scans lines (gate lines) of the liquid crystal panel 2 in response to the scan line driver control signal 7.

The controller driver 4 is provided with a memory control circuit 11, a display memory 12, an approximation calculation correcting circuit 13, a correction point data storage register set 14, a color subtraction processing circuit 15, a latch circuit 16, a signal line driving circuit 17, a gradation voltage generating circuit 18, and a timing control circuit 19.

The memory control circuit 11 has a function of writing the input gradation data $D_{IN}$ transmitted from the image drawing circuit 3 into the display memory 12. More specifically, the memory control circuit 11 generates a display memory control signal 22 from the memory control signal 6 transmitted from the image drawing circuit 3 and a timing control signal 21 transmitted from the timing control circuit 19 to control the display memory 12. Further, the memory control circuit 11 transfers the input gradation data $D_{IN}$ transmitted from the image drawing circuit 3 in synchronization with the memory control signal 6 to the display memory 12 so that the input gradation data $D_{IN}$ is written into the display memory 12.

The display memory 12 is a memory for temporarily holding the input gradation data $D_{IN}$ transmitted from the image drawing circuit 3 inside the controller driver 4. The display memory 12 has a capacity for one frame, that is, the capacity of m×3n×6 bits. The display memory 12 sequentially outputs the input gradation data $D_{IN}$ in response to the display memory control signal 22 transmitted from the memory control circuit 11. The input gradation data $D_{IN}$ are outputted for every pixel set for one line of the liquid crystal panel 2.

The approximation calculation correcting circuit 13 carries out the gamma correction on the input gradation data $D_{IN}$ sent from the display memory 12. The approximation calculation correcting circuit 13 approximately carries out the gamma correction through data processing on the input gradation data $D_{IN}$ and generates the output gradation data $D_{OUT}$. What is meant by the word approximately is that the gamma correction is carried out based on not the exact equation (1) described above but a calculation equation that is more advantageous in the mounting. Hereinafter, the output gradation data $D_{OUT}$ corresponding to an R (red) pixel is indicated as output R data $D_{OUT}^R$. Similarly, the output gradation data $D_{OUT}$ corresponding to G and B pixels are indicated as output G data $D_{OUT}^G$ and output B data $D_{OUT}^B$, respectively. The output gradation data $D_{OUT}$ is 8-bit data which has a larger number of bits than the input gradation data $D_{IN}$. The larger number of bits in the output gradation data $D_{OUT}$ than in the input gradation data $D_{IN}$ is effective in preventing the degradation of pixel gradation through the gamma correction.

For the gamma correction carried out by the approximation calculation correcting circuit 13, not the LUT but the calculation equation is used. Coefficients of the calculation equation are determined based on the correction point data CP0 to CP5 transmitted from the image drawing circuit 3. Thus, the shape of a gamma curve used for the gamma correction, that is, gamma values used for the gamma correction are controlled. In addition, in this embodiment, the approximation calculation correcting circuit 13 is provided with a function of carrying out the gamma correction in accordance with the calculation equation selected from among a plurality of calculation equations. As described in detail later, the calculation equation is selected based on the input gradation data $D_{IN}$ and the correction point data CP0 to CP5 transmitted from the image drawing circuit 3. This is important in order to carry out the gamma correction by using an appropriate calculation equation.

The correction point data storage register set 14 is used for storing the correction point data CP0 to CP5 in the controller driver 4. The correction point data storage register set 14 receives the correction point data CP0 to CP5 from the image drawing circuit 3, and holds the received correction point data CP0 to CP5. The held correction point data CP0 to CP5 are transferred to the approximation calculation correcting circuit 13 for the gamma correction.

The color subtraction processing circuit 15 carries out color subtraction processing on the output gradation data Dour generated by the approximation calculation correcting circuit 13. Thus, post color subtraction output gradation data $D_{OUT\text{-}D}$ are generated.

The latch circuit 16 latches the post color subtraction output gradation data $D_{OUT\text{-}D}$ from the color subtraction processing circuit 15 in response to a latch signal 23, and transfers the latched post color subtraction output gradation data $D_{OUT\text{-}D}$ to the signal line driving circuit 17.

The signal line driving circuit 17 drives signal lines of the liquid crystal panel 2 in response to the post color subtraction output gradation data $D_{OUT\text{-}D}$ transmitted from the latch circuit 16. More specifically, the signal line driving circuit 17 selects a corresponding gradation voltage from among a plurality of gradation voltages which are supplied from the gradation voltage generating circuit 18, in response to the post color subtraction output gradation data $D_{OUT\text{-}D}$, and drives the corresponding one of the signal lines of the liquid crystal panel 2 in the selected gradation voltage. In this embodiment, the number of gradation voltages supplied from the gradation voltage generating circuit 16 is 64.

The timing control circuit 19 carries out timing control of the liquid crystal display apparatus 1. Specifically, the timing control circuit 19 generates the scan line driver control signal 7, the timing control signal 21, and the latch signal 23, and supplies them to the scan line driver 5, the memory control circuit 11, and the latch circuit 16, respectively. The operation timings of the scan line driver control signal 7, the timing control signal 21, and the latch signal 23 are controlled in response to these control signals.

Figure 2:
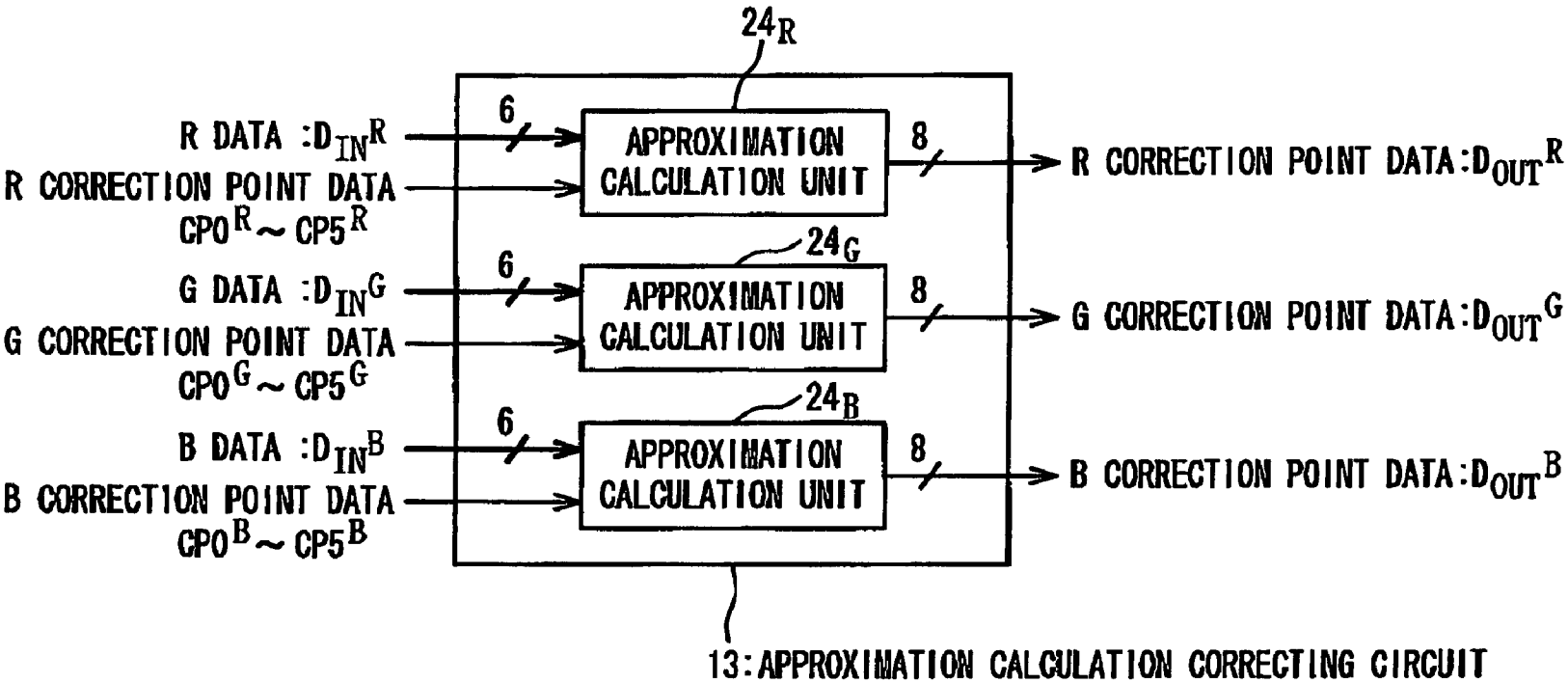
FIG. 2 is a block diagram showing the configuration of an approximation calculation correcting circuit of the liquid crystal display apparatus of the present embodiment.

Next, the approximation calculation correcting circuit 13 will be described in more detail. FIG. 2 is a block diagram showing the configuration of the approximation calculation correcting circuit 13 that carries out the gamma correction. The approximation calculation correcting circuit 13 is provided with approximation calculation units $\mathbf{24}_R$, $\mathbf{24}_G$, and $\mathbf{24}_B$ provided for R, G, and B, respectively. The approximation calculation units $\mathbf{24}_R$, $\mathbf{24}_G$, and $\mathbf{24}_B$ carry out the gamma correction based on the calculation equations for the input gradation data $D_{IN}^R$, $D_{IN}^G$, and $D_{IN}^B$, respectively, and generate the output gradation data $D_{OUT}^R$, $D_{OUT}^G$, and $D_{OUT}^B$, respectively. As described above, the number of bits in each of the output gradation data $D_{OUT}^R$, $D_{OUT}^G$, and $D_{OUT}^B$ is 8 bits, which is larger than the number of bits in each of the input gradation data $D_{IN}^R$, $D_{IN}^G$, and $D_{IN}^B$.

Coefficients of the calculation equation used for the gamma correction by the approximation calculation unit $\mathbf{24}_R$ are determined based on the correction point data $CP\mathbf{0}^R$ to $CP\mathbf{5}^R$. Similarly, coefficients of the calculation equations used for the gamma correction by the approximation arithmetic units $\mathbf{24}_G$ and $\mathbf{24}_B$ are determined based on the correction point data $CP\mathbf{0}^G$ to $CP\mathbf{5}^G$ and the correction point data $CP\mathbf{0}^B$ to $CP\mathbf{5}^B$, respectively.

The functions of the approximation calculation units $\mathbf{24}_R$, $\mathbf{24}_G$, and $\mathbf{24}_B$ are identical to each other except for the point that the input gradation data and the correction point data inputted therein are different for every color. Hereinafter, when the approximation calculation units $\mathbf{24}_R$, $\mathbf{24}_G$, and $\mathbf{24}_B$ are not discriminated from each other, the subscripts are omitted and they are just indicated as the approximation calculation units 24.

The calculation equation used for the gamma correction by the approximation arithmetic unit 24 is switched depending on two major classified conditions. The first condition is a value of the input gradation data $D_{IN}$. The possible range of the input gradation data $D_{IN}$ is divided into a plurality of data ranges, so that the gamma correction can be accurately achieved by using the different calculation equations in the different data ranges. The second condition is a gamma value γ of the gamma correction to be achieved. The shape of the gamma curve varies depending on the gamma value γ. Selection of the calculation equation according to the gamma value γ allows the shape of the gamma curve to be approximately reproduced, thereby permitting more accurately achieving gamma correction. More specifically, in this embodiment, the calculation equation used for gamma correction is selected from among a plurality of calculation equations based on two conditions below:

(a) whether or not the input gradation data $D_{IN}$ is larger than intermediate data value $D_{IN}^{Center}$; and (b) whether or not the gamma value γ of the gamma correction to be achieved is less than one, where the intermediate data value $D_{IN}^{Center}$ is a value defined from the following equation (2) by using a permissible maximum value $D_{IN}^{MAX}$ of the input gradation data $D_{IN}$:

$$D_{IN}^{Center}=D_{IN}^{MAX}/2 \tag{2}$$

Figure 3:
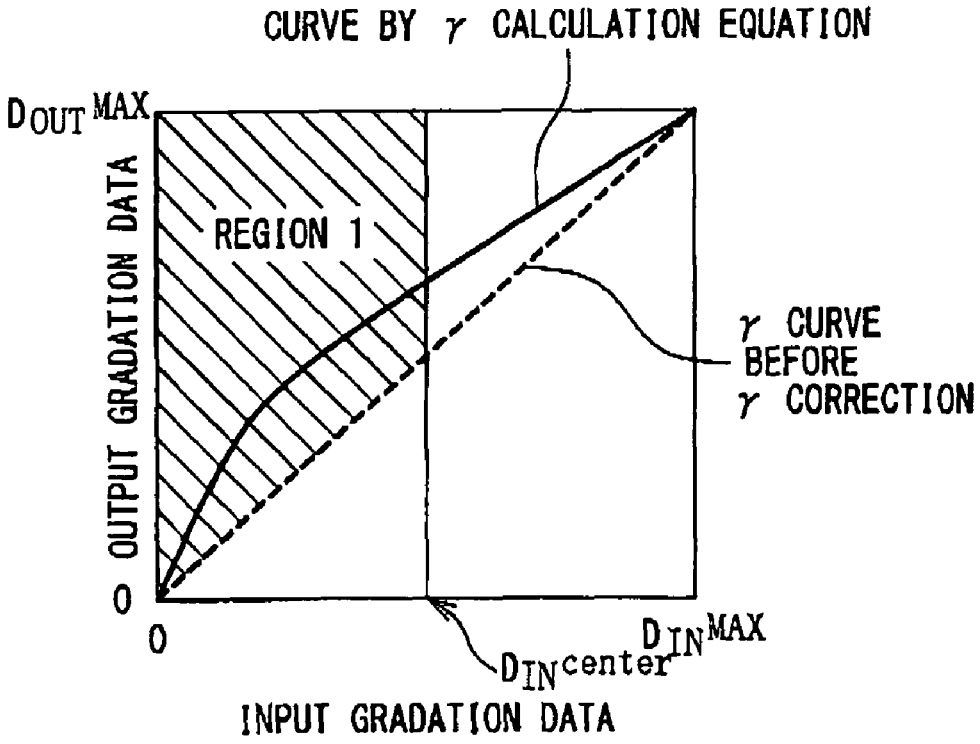
FIG. 3 is a diagram showing a region where switching of a calculation equation is carried out.

Referring to FIG. 3, when the input gradation data $D_{IN}$ is smaller than the intermediate data value $D_{IN}^{Center}$ and when the gamma value γ of the gamma correction to be achieved is less than one, that is, when the gamma curve in a region 1 shown in FIG. 3 is used for approximation, the calculation equation is used which has a term proportional to the n1-th ($0<n1<1$) power of the input gradation data $D_{IN}$, $D_{IN}^{n1}$ but does not have a term proportional to the n2-th ($n2>1$) power of the input gradation data $D_{IN}$, $D_{IN}^{n2}$. In this embodiment, the calculation equation is used which has a term proportional to the ½ power of the input gradation data $D_{IN}$, $D_{IN}^{1/2}$. In other cases, the calculation equation which has a term proportional to the n2-th ($n2>1$) power of the input gradation data $D_{IN}$, $D_{IN}^{n2}$ but does not have a term proportional to the n1-th ($0<n1<1$) power of the input gradation data $D_{IN}$, $D_{IN}^{n1}$ is used for gamma correction. In this embodiment, the calculation equation is used which has a term proportional to the second power of the input gradation data $D_{IN}$, $D_{IN}^2$.

This is based on that there is a difference between the calculation equation suitable for the gamma curve for a gamma value γ larger than one and the calculation equation suitable for the gamma curve for a gamma value γ less than one. For example, the gamma curve for the gamma value γ larger than one can be approximated very accurately by quadratic polynomial. However, the quadratic polynomial is not suitable for the approximation of the gamma curve for the gamma value γ less than one. The use of the quadratic polynomial is not suitable because of increase of a difference from the exact equation especially when the input gradation data $D_{IN}$ is close to 0. Use of the calculation equation having a term proportional to the n1-th ($0<n1<1$) power of the input gradation data $D_{IN}$, $D_{IN}^{n1}$, especially, use of the calculation equation having a term proportional to ½ power of the input gradation data $D_{IN}$ $D_{IN}^{1/2}$ allows the approximation of the gamma curve for a gamma value γ less than one to be carried out in few error.

In this embodiment, the approximation calculation units 24$_R$, 24$_G$, and 24$_B$ calculate the output gradation data $D_{OUT}$ by using the following equations:

(1) when the input gradation data $D_{IN}$ is smaller than the intermediate data value $D_{IN}^{Center}$ and the gamma value γ is smaller than one:

$$D_{out} = \frac{2(CP1 - CP0) \cdot PD_{INS}}{K^3} + \frac{(CP3 - CP0)D_{INS}}{K} + CP0. \quad (3a)$$

(2) when the input gradation data $D_{IN}$ is smaller than intermediate data value $D_{IN}^{Center}$ and the gamma value γ is equal to or larger than one:

$$D_{OUT} = \frac{2(CP1 - CP0) \cdot ND_{INS}}{K^3} + \frac{(CP3 - CP0)D_{INS}}{K} + CP0. \text{ and} \quad (3b)$$

(3) when the input gradation data $D_{IN}$ is equal to or larger than the intermediate data value $D_{IN}^{Center}$:

$$D_{OUT} = \frac{2(CP4 - CP2) \cdot ND_{INS}}{K^3} + \frac{(CP5 - CP2)D_{INS}}{K} + CP2. \quad (3c)$$

In this case, the parameters K, $D_{INS}$, $PD_{INS}$, and $ND_{INS}$ appearing in the equations (3a) to (3c) are values defined as described below.

(1) K

K is given in accordance with the following equation:

$$K=(D_{IN}^{MAX}+1)/2 \quad (4)$$

It should be noted that K is a number represented by n-th (n is an integer number larger than one) power of 2, i.e., $2^n$. The maximum value $D_{IN}^{MAX}$ of the input gradation data $D_{IN}$ is a value obtained by subtracting one from the number represented by $2^n$. For example, when the input gradation data $D_{IN}$ is 6-bit data, the maximum value $D_{IN}^{MAX}$ is 63. Therefore, the parameter K provided by the equation (4) is represented by $2^n$, which is useful for performing calculation of the equations (3a) to (3c) with the simple circuit configuration. Division of the number represented by $2^n$ can be achieved simply with a right shift circuit. The equations (3a) to (3c) include division by K, which is the number represented by $2^n$. Thus, this division can be achieved with the simple circuit.

(2) $D_{INS}$ $D_{INS}$ is a value determined depending on the input gradation data $D_{IN}$, and is provided by the following equations (5a) and (5b):

$$D_{INS}=D_{IN}(D_{IN}<D_{IN}^{Center}) \quad (5a)$$

$$D_{INS}=D_{IN}+1-K(D_{IN}>D_{IN}^{Center}) \quad (5b)$$

(3) $PD_{INS}$ $PD_{INS}$ is defined by the following equation (6a) by using a parameter R defined by the equation (6b):

$$PD_{INS}=(K-R)\cdot R \quad (6a)$$

$$R=K^{1/2}\cdot D_{INS}^{1/2} \quad (6b)$$

As understood from the equations (6b), (5a), and (5b), the parameter R is a value proportional to the ½ power of the input gradation data $D_{IN}$, i.e., $D_{IN}^{1/2}$. Therefore, the $PD_{INS}$ is calculated from the equation including a term proportional to the (½)-th power of the input gradation data $D_{IN}$, i.e. $D_{IN}^{1/2}$ and a term proportional to the first power of the input gradation data $D_{IN}$, i.e. $D_{IN}$.

(4) $ND_{INS}$ $ND_{INS}$ is provided by the following equation;

$$ND_{INS}=(K-D_{INS})\cdot D_{INS} \quad (7)$$

As understood from the equations (7), (5a), and (5b), $ND_{INS}$ is calculated by the equation including a term proportional to the second power of input gradation data $D_{IN}$, i.e. $D_{IN}^2$.

As described above, the data CP0 to CP5 are correction point data supplied from the image drawing circuit 3, and parameters for determining the shape of the gamma curve. To perform the gamma correction on the basis of the gamma value γ in the controller driver 4, the correction point data CP0 to CP5 may be determined as shown by the following equations (8a) and (8b), and then may be supplied to the controller driver 4:

(1) when γ<1:

$$CP0$$

$$CP1=(4\cdot\text{Gamma}[K/4]-\text{Gamma}[K])/2$$

$$CP2=\text{Gamma}[K-1]$$

$$CP3=\text{Gamma}[K]$$

$$CP4=2\cdot\text{Gamma}[D_{IN}^{MAX}+K-1]-D_{OUT}^{MAX}$$

$$CP5=D_{OUT}^{MAX} \quad (8a)$$

(2) when γ>1:

$$CP0$$

$$CP1=2\cdot\text{Gamma}[K/2]-\text{Gamma}[K]$$

$$CP2=\text{Gamma}[K-1]$$

$$CP3=\text{Gamma}[K]$$

$$CP4=2\cdot\text{Gamma}[D_{IN}^{MAX}+K-1]-D_{OUT}^{MAX}$$

$$CP5=D_{OUT}^{MAX} \quad (8b)$$

where the Gamma[X] is a function defined by the following equation:

$$\text{Gamma}[x]=D_{OUT}^{MAX}\cdot(x/D_{IN}^{MAX})^{\gamma} \quad (9)$$

It should be noted that the equations (8a) and (8b) differ from each other in the calculation equation for the correction point data CP1.

One of features of the above equations (3a) to (3c) is in that a term representing a curved line, a term representing a straight line; and a constant term are contained. As can be understood from the fact that the value $PD_{INS}$ is dependent on ½-th power of the input gradation data $D_{IN}$ i.e. $D_{IN}^{1/2}$ and that the value $ND_{INS}$ is dependent on the second power of the input gradation data $D_{IN}$, i.e. $D_{IN}^2$, first terms of the equations (3a) to (3c) represent curved lines. The second terms are proportional to $D_{INS}$, thus representing straight lines. Each of CP0 and CP2 has no relation to the input gradation data $D_{IN}$, and thus is a constant term. The use of such equations for gamma correction allows the gamma correction to be approximately carried out while reducing an error.

Figure 4:
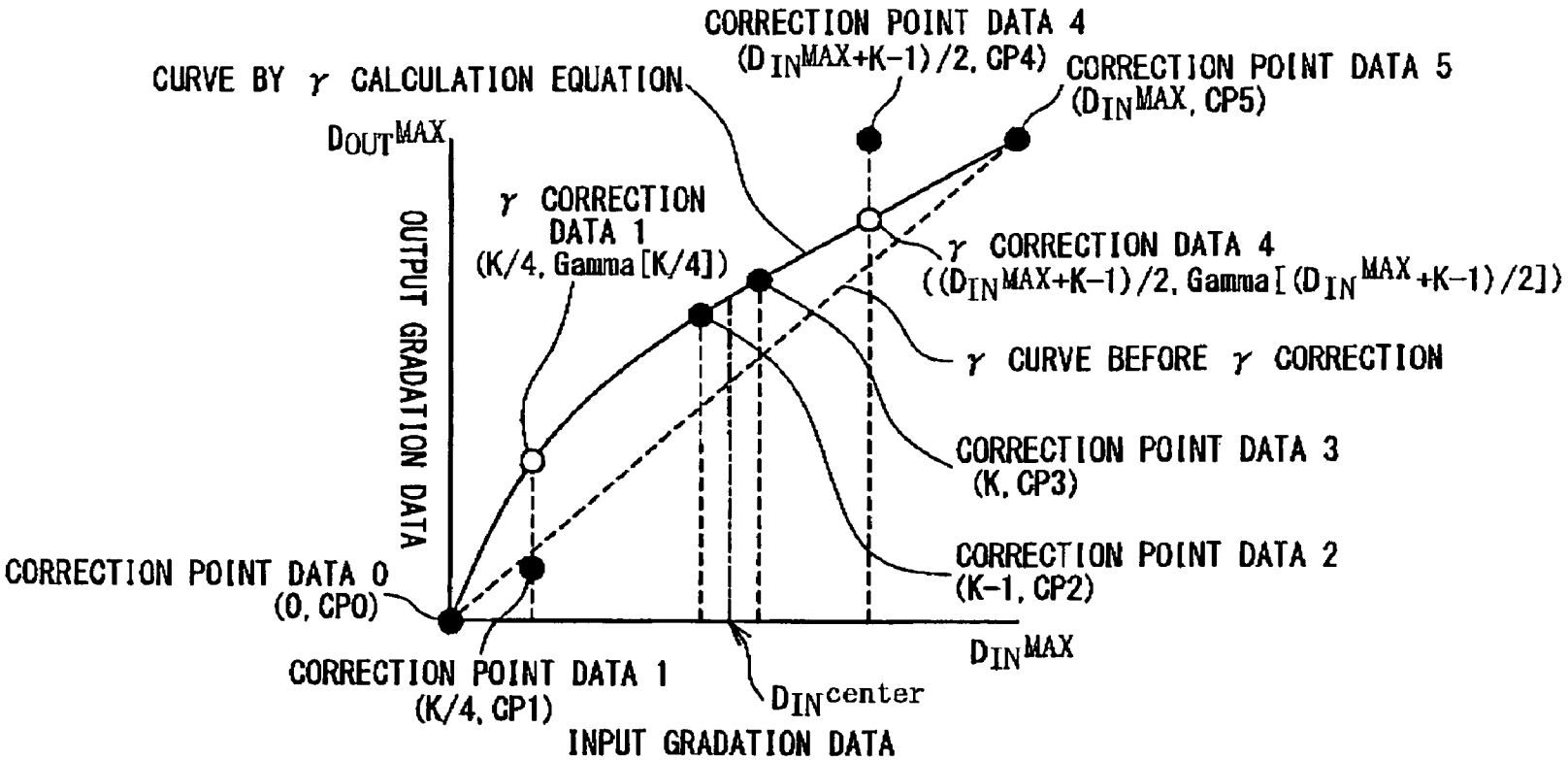
FIG. 4 is a graph showing the shape of a gamma curve achieved by the calculation equation where the gamma value for gamma correction is less than one.
Figure 5:
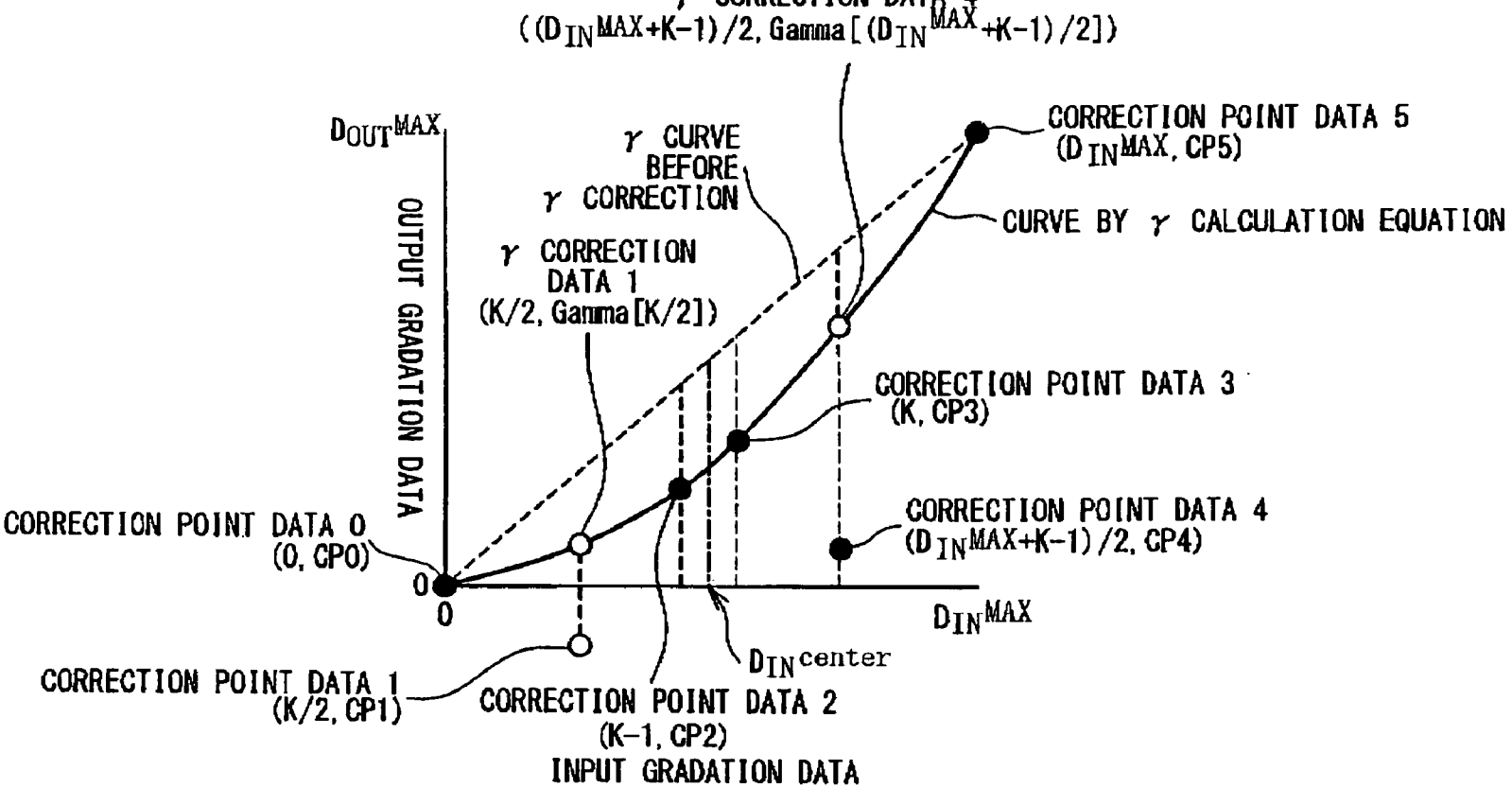
FIG. 5 is a graph showing the shape of the gamma curve achieved by the calculation equation where the gamma value of gamma correction exceeds one.

FIG. 4 shows the shape of a gamma curve obtained from the calculation equation when the correction point data CP0 to CP5 are determined from the equation (8a) in case of $\gamma<1$. If the correction point data CP0 to CP5 are determined from the equation (8a) and the input gradation data $D_{IN}$ is calculated from the equations (3a) and (3c) in case of $\gamma<1$, the output gradation data $D_{OUT}$ obtained from the exact equation (1) and the output gradation data $D_{OUT}$ obtained from the calculation equations (3a) and (3b) are coincident with each other in four cases where the input gradation data $D_{IN}$ is 0, K/4, $(D_{IN}^{MAX}+K-1)$, and $D_{IN}^{MAX}$. On the other hand, FIG. 5 shows the shape of the gamma curve obtained from the calculation equation when the correction point data CP0 to CP5 are determined from the equation (8b) in case of $\gamma>1$. If the correction point data CP0 to CP5 are determined from the equation (8b) and the input gradation data $D_{IN}$ is calculated from the equations (3b) and (3c) in case of $\gamma>1$, the output gradation data $D_{OUT}$ obtained from the exact equation (1) and the output gradation data $D_{OUT}$ obtained from the calculation equations (3a) and (3b) are coincident with each other in four cases where the input gradation data $D_{IN}$ is 0, K/2, $(D_{IN}^{MAX}+K-1)$, and $D_{IN}^{MAX}$, respectively. For example, when the input gradation data $D_{IN}$ is 6-bit data and the output gradation data $D_{OUT}$ is 8-bit data, the $D_{IN}^{MAX}$ is 63, $D_{IN}^{Center}$ is 31.5, and $D_{OUT}^{MAX}$ is 255, and further K is 32.

When the gamma value $\gamma$ is desired to be set to 0.9 (<1), the correction value data CP0 to CP5 are set to the following values from the equation (8a):

CP0=0
CP1=10.3
CP2=134.7
CP3=138.6
CP4=136.8
CP5=255

In this case, when $D_{IN}$ is 8, that is, $D_{IN}$ is coincident with K/4, the output gradation data $D_{OUT}$ calculated from the equation (3a) is 39.8. This value is coincident with the value of the output gradation data $D_{OUT}$ obtained from the exact equation (1) where $\gamma$ is set to 0.9 and $D_{IN}$ is set to 8.

Similarly, when $D_{IN}$ is 47, that is, $D_{IN}$ is coincident with $(D_{IN}^{MAX}+K-1)/2$, the output gradation data $D_{OUT}$ calculated from the equation (3c) is 195.9. This value is coincident with the value of the output gradation data $D_{OUT}$ obtained by the equation (1), i.e., the exact equation, where $\gamma$ is set at 0.9 and $D_{IN}$ is set at 47.

Similarly, when the gamma value $\gamma$ is desired to be set to 1.8 (>1), the correction value data CP0 to CP5 are set to values below in accordance with the equation (8b):

CP0=0
CP1=32.1
CP2=71.2
CP3=75.3
CP4=46.0
CP5=255

In this case, when $D_{IN}$ is 16, that is, $D_{IN}$ is coincident with K/2, the output gradation data $D_{OUT}$ calculated from the equation (3b) is 21.6. This value is coincident with the value of the output gradation data $D_{OUT}$ obtained from the exact equation (1), where $\gamma$ is set to 1.8 and $D_{IN}$ is set to 16.

Similarly, when $D_{IN}$ is 47, that is, $D_{IN}$ is coincident with $(D_{IN}^{MAX}+K-1)/2$, the output gradation data $D_{OUT}$ calculated from the equation (3c) is 150.5. This value is coincident with the value of the output gradation data $D_{OUT}$ obtained from the exact equation (1), where $\gamma$ is set to 1.8 and $D_{IN}$ is set to 47.

What should be noted is that the values of the input gradation data $D_{IN}$ are different in case of $\gamma<1$ and in case of $\gamma>1$ when the output gradation data obtained from the exact equation (1) and the output gradation data obtained from the equations (3a) to (3e) are coincident with each other. Specifically, in case of $\gamma<1$, these values are coincident with each other when the input gradation data $D_{IN}$ is K/4, whereas in case of $\gamma>1$, these values are coincident with each other when the input gradation data $D_{IN}$ is K/2. That is, the smallest value of the input gradation data $D_{IN}$ (other than 0) when the output gradation data obtained from the exact equation (1) and the output gradation data obtained from the equations (3a) to (3e) are coincident with each other is smaller in case of $\gamma<1$ than in case of $\gamma>1$. As can be understood from FIGS. 4 and 5, in case of $\gamma<1$ that the gamma curve is convex upward, the output gradation data $D_{OUT}$ drastically rises near the origin with respect to the input gradation data $D_{IN}$; whereas in case of $\gamma>1$ that the gamma curve is convex downward, it rises relatively gently. In accurately approximating the shape of such a gamma curve, it is effective that the smallest value of the input gradation data $D_{IN}$ (other than 0) when the two output gradation data are coincident with each other is smaller in case of $\gamma<1$ than in case of $\gamma>1$.

Another point to be noted is that the equations (3a) to (3c) have similar shapes. The only difference among the equations (3a) to (3c) is in selection of which of $PD_{INS}$, and $ND_{INS}$ to be used, in the coefficients for $PD_{INS}$, $ND_{INS}$ and $D_{INS}$, and in the constant term. This is advantageous in implementing the equations (3a) to (3c) on an integrated circuit. In detail, a, calculation circuit performing calculation represented by the following equation (10) is provided in the approximation calculation units 24, and a variable $D_{IN}^{se1}$ and the coefficients A, B, and C are appropriately switched. Thus, the calculation on the basis of the equations (3a) to (3c) is achieved with the simple circuit:

$$D_{OUT} = \frac{B \cdot D_{IN}^{sd}}{(K^2/2)} + \frac{C \cdot D_{INS}}{K} + A, \tag{10}$$

For example, $PD_{INS}$ can be supplied as the variable $D_{IN}^{se1}$ to the calculation circuit which performs calculation represented by the equation (10), and further CP0, CP1 to CP0, and CP3 to CP0 can be set as the coefficients A, B, and C, respectively. Thus, the calculation of the equation (3a) is carried out. Moreover, $ND_{INS}$ can be supplied as the variable $D_{IN}^{se1}$ to the calculation circuit and further CP2, CP4 to CP2, and CP5 to CP2 can be set as the coefficient A, B, and C, respectively, Thus, the calculation of the equation (3c) is carried out. The implementing of the equations (3a) to (3c) in the integrated circuit will be described in detail later.

In the liquid crystal display apparatus 1 having such a configuration, the gamma value of the gamma correction is switched through the following operation. To change the gamma value $\gamma$ of the gamma correction to be carried out by the controller driver 4, the image drawing circuit 3 determines the gamma values $\gamma$ for R, G, and B, respectively, and further calculates the correction point data CP0 to CP5 for R, G, and B, respectively, from the equations (8a), (8b), and (9). The calculated correction point data CP0 to CP5 are transmitted to the controller driver 4 to update the correction point data CP0 to CP5 stored in the correction point data storage register set 14. Thereafter, the approximation calculation correcting circuit 13 calculates the output gradation data $D_{OUT}$ based on the updated correction point data CP0 to CP5.

By switching the gamma value $\gamma$ through such a procedure, the volume of data transmitted from the image drawing circuit 3 to the controller driver 4 can be effectively suppressed. For example, assuming that the correction point data CP0 to CP5 are each expressed by 8 bits, switching of the gamma value γ can be achieved by just transmitting data of as small as 48 bits to the controller driver 4. This makes it possible to instantly switch the gamma curve used for the correction.

Provision of the correction point data storage register set 14 in the controller driver 4 is effective for suppressing volume of data transmitted from the image drawing circuit 3 to the controller driver 4. Provision of the correction point data storage register 14 and saving the correction point data CP0 to CP5 in the controller driver 4 eliminates the need for the controller driver 4 to receive the correction point data CP0 to CP5 except for upon updating the gamma value γ, which is preferable in terms of suppressing the volume of data transmitted from the image drawing circuit 3 to the controller driver 4

Figure 6:
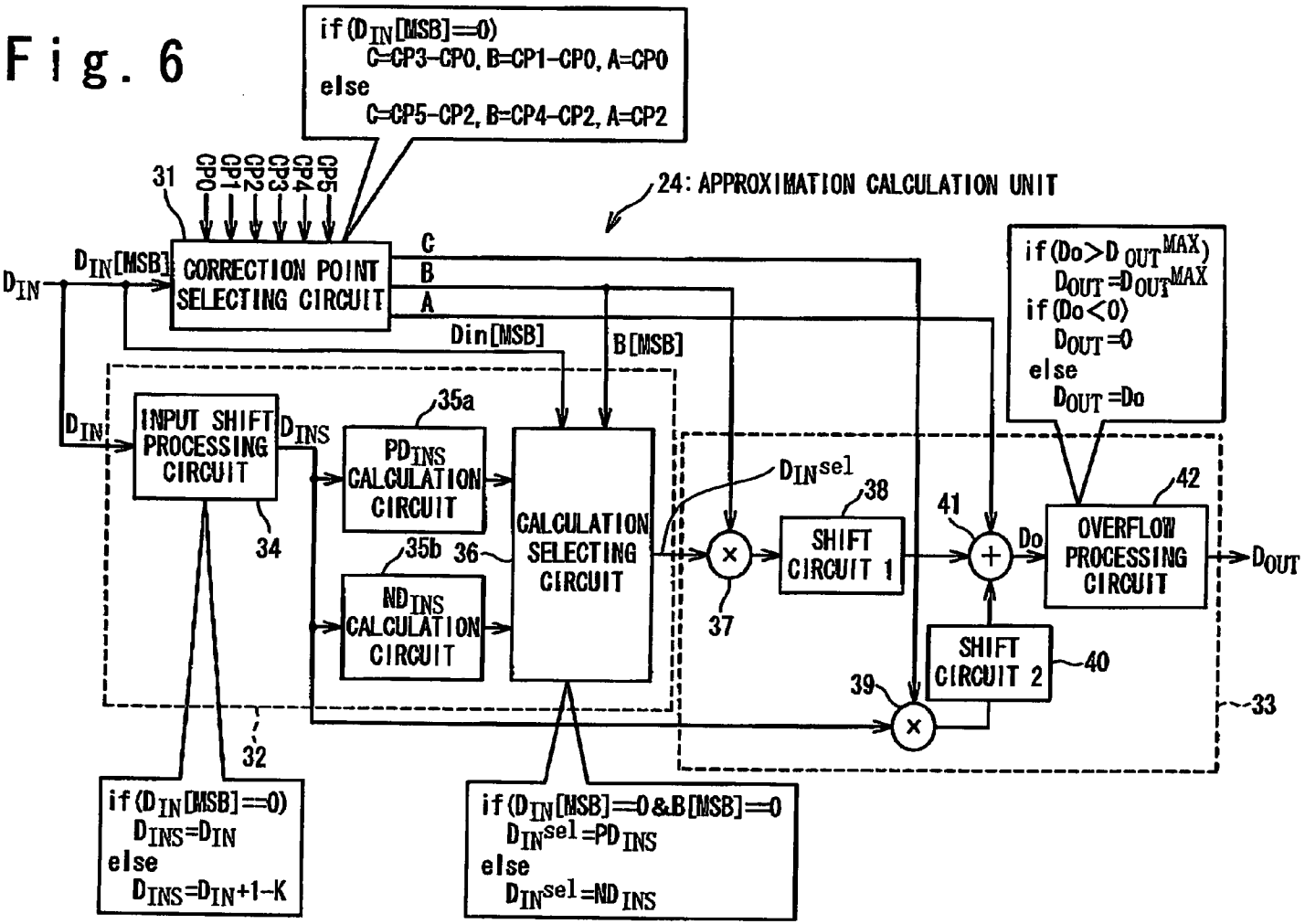
FIG. 6 is a block diagram showing the configuration of approximation calculation unit of the liquid crystal display apparatus of the present embodiment.

Next, FIG. 6 is a block diagram showing preferable configuration of the approximation calculation units 24 for embodying the gamma correction based on the above calculation equation. In this embodiment, the approximation calculation unit 24 is provided with a correction point selecting circuit 31, an order switching circuit 32, and an output gradation data calculating circuit 33.

The correction point selecting circuit 31 is a circuit which calculates the coefficients A, B, and C based on the correction point data CP0 to CP5. The coefficients A, B, and C calculated by the correction point selecting circuit 31 correspond to the coefficients A, B, and C, respectively, appearing in the equations (10) described above. The calculated coefficients A, B, and C are used for arithmetic carried out in the output gradation data calculating circuit 33. The coefficients A, B, and C are expressed as binary numbers with signs.

The coefficients A, B, and C are determined depending on whether the input gradation data $D_{IN}$ is larger or smaller than the intermediate data value $D_{IN}^{Center}$. When the most significant bit (MSB) of the input gradation data $D_{IN}$ is 0, the correction point selecting circuit 31 determines that the input gradation data $D_{IN}$ is smaller than the intermediate data value $D_{IN}^{Center}$, and calculates the coefficient A, B, and C from the following equations (11a):

$$C=CP3-CP0$$

$$B=CP1-CP0$$

$$A=CP0 \tag{11a}$$

On the other hand, when the most significant bit (MSB) of the input gradation data $D_{IN}$ is 1, the correction point selecting circuit 31 determines that the input gradation data $D_{IN}$ is larger than the intermediate data value $D_{IN}^{Center}$, and calculates the coefficients A, B, and C from the following equations (11b):

$$C=CP5-CP2$$

$$B=CP4-CP2$$

$$A=CP2 \tag{11b}$$

An order switching circuit 32 calculates the value $PD_{INS}$ defined by the equations (6a) and (6b), and the value $ND_{INS}$ defined by the equation (7) based on the input gradation data $D_{IN}$, and one of the values $PD_{INS}$ and $ND_{INS}$ to be used for the gamma correction is supplied to the output gradation data arithmetic circuit 33. Specifically, the order switching circuit 32 is provided with an input shift processing circuit 34, a $PD_{INS}$ calculation circuit 35*a*, an $ND_{INS}$ calculation circuit 35*b*, and a calculation selecting circuit 36. The input shift processing circuit 34 calculates the value $D_{INS}$ defined by the equations (5a) and (5b) based on the input gradation data $D_{IN}$. More specifically, if the most significant bit of the input gradation data $D_{IN}$ is 0, $D_{INS}$ is set to the same value as that of the input gradation data $D_{IN}$, and if not, $D_{INS}$ is set to the value $D_{IN}+1-K$.

The $PD_{INS}$ calculation circuit 35*a* is a combination circuit that calculates the value $PD_{INS}$ defined by the equations (6a) and (6b) based on the value $D_{INS}$. The logic of the $PD_{INS}$ calculation circuit 35*a* is designed so that for all the possible values provided for $D_{INS}$, $PD_{INS}$ corresponding to inputted $D_{INS}$ is outputted. It should be noted that the LUT is not used for the calculation of the value $PD_{INS}$. As would be clear from the equations (6a) and (6b), the $PD_{INS}$ does not depend on the correction point data CP0 to CP5, that is, does not depend on the gamma value γ. Thus, the correspondence between $D_{INS}$ and $PD_{INS}$ is constant during the gamma correction based on any gamma value γ. This means that the calculation of the value $PD_{INS}$ based on the value $D_{INS}$ can be achieved by the combination circuit once the logic of the calculation of the value $PD_{INS}$ based on the value $D_{INS}$ is derived through logic synthesis. The use of the combination circuit, instead of the LUT, for the calculation of the value $PD_{INS}$ is effective in downsizing the $PD_{INS}$ arithmetic circuit 35*a*.

The $ND_{INS}$ calculation circuit 35*b* is a combination circuit that calculates the value $ND_{INS}$ defined by the equation (7) based on the value $D_{INS}$. Like the $PD_{INS}$ calculation circuit 35*a*, the logic of the $ND_{INS}$ calculation circuit 35*b* is designed so that, for all the possible values provided for $D_{INS}$, $ND_{INS}$ corresponding to inputted $D_{INS}$ is outputted. Like the value $PD_{INS}$, the value $ND_{INS}$ does not depend on the correction point data CP0 to CP5, that is, does not depend on the gamma value γ. Thus, the correspondence between the $D_{INS}$ and the $ND_{INS}$ is constant during the gamma correction of any gamma value γ. This makes it possible to use a combination circuit for the calculation of the value $ND_{INS}$, thereby permitting downsizing the $ND_{INS}$ calculation circuit 35*b*.

The calculation selecting circuit 36 is a circuit that selects as the variable $D_{IN}^{sel}$, one of the value $PD_{INS}$ calculated by the $PD_{INS}$ calculation circuit 35*a* and the value $ND_{INS}$ calculated by the $ND_{INS}$ calculation circuit 35*b*. The selection between the value $PD_{INS}$ and the value $ND_{INS}$ is made in accordance with whether or not the gamma value γ of the gamma correction to be achieved is larger than one and whether or not the input gradation data $D_{IN}$ is larger than the intermediate data value $D_{IN}^{Center}$. If the most significant bit (MSB) of the coefficient B is 0 and the most significant bit of the input gradation data $D_{IN}$ is 0, the calculation selecting circuit 36 determines that the gamma value γ is smaller than one and that the input gradation data $D_{IN}$ is smaller than the intermediate data value $D_{IN}^{Center}$, and selects the value $PD_{INS}$ as the variable $D_{IN}^{sel}$. If not, the calculation selecting circuit 36 selects the value $ND_{INS}$ as the variable $D_{IN}^{sel}$.

The output gradation data calculating circuit 33 carries out the calculation of the equation (10) based on the variable $D_{IN}^{sel}$ supplied from the order switching circuit 32 and the coefficients A, B, and C supplied from the correction point selecting circuit 31 and outputs the output gradation data $D_{OUT}$. Specifically, the output gradation data calculating circuit 33 is provided with a multiplier 37, a shift circuit 38, a multiplier 38, a shift circuit 40, an adder 41, and an overflow processing circuit 42. The multiplier 37 multiplies the variable $D_{IN}^{sel}$ supplied from the order switching circuit 32 by the coefficient B supplied from the correction point selecting circuit 31. The shift circuit 38 performs right shift on an output of the multiplier 37. This is an equivalent operation to division of the value $B \times D_{IN}^{sel}$ by $(K^2/2)$ and output of the first term of the equation (10). It should be noted that K is a number represented by $2^n$. When K=2, the shift circuit 38 is so configured as to perform right shift by (2n−1) bits.

The multiplier 39 multiplies the value $D_{INS}$ supplied from the order switching circuit 32 by the coefficient C supplied from the correction point selecting circuit 31. The shift circuit 40 performs right shift on an output of the multiplier 39. This is an equivalent operation to division of the value $C \times D_{IN}^{se1}$ by the value K and output of the second term of the equation (10). When $K=2^n$, the shift circuit 40 is so configured as to perform right shift by n bits.

The adder 41 calculates a sum of outputs of the shift circuits 38 and 40 and a coefficient A. An output Do of the adder 41 almost corresponds to the output gradation data $D_{OUT}$ to be finally obtained.

The overflow processing circuit 42 carries out overflow processing on the output Do of the adder 41 to finally output the output gradation data $D_{OUT}$. Specifically, if the output Do of the adder 41 is larger than the permissible maximum value $D_{IN}^{MAX}$ of the output gradation data $D_{OUT}$, the overflow processing circuit 42 sets the output gradation data $D_{OUT}$ to the maximum value $D_{IN}^{MAX}$. If the output Do of the adder 41 is a negative value, the overflow processing circuit 42 sets the output gradation data $D_{OUT}$ to 0. In neither case, the overflow processing circuit 42 outputs the output Do of the adder 41 as the output gradation data $D_{OUT}$.

The configuration of such an approximation calculation unit 24 makes it possible to achieve the gamma correction with fewer error and with a small circuit size. First, in the approximation calculation units 24 of FIG. 6, the output gradation data calculating circuit 33 is commonly used for the calculation of the equations (3a) to (3c), which is effective in reducing the circuit size. Secondarily, by utilizing the characteristic that the value $PD_{INS}$ and the value $ND_{INS}$ do not depend on the gamma value γ, the combination circuits are used for the calculation of the value $PD_{INS}$ and the value $ND_{INS}$, respectively, so that one of the value $PD_{INS}$ and the value $ND_{INS}$ as the variable $D_{IN}^{se1}$ to be supplied to the output gradation data calculating circuit 33 is selected. The use of the combination circuits, instead of the LUT, for the calculation of the value $PD_{INS}$ and the value $ND_{INS}$ is effective in reducing the circuit size. In addition, one of the value $PD_{INS}$ dependent on the ½-th power of the input gradation data $D_{IN}$ and the value $ND_{INS}$ dependent on the second power of the input gradation data $D_{IN}$, which is appropriately selected, is used for the calculation of the output gradation data $D_{OUT}$. Thus, the gamma correction with reduced error can be achieved.

According to the present invention, a display apparatus can be provided which is capable of achieving the accurate gamma correction while also capable of instantly switching the gamma curve used for the correction.

What is claimed is:

1. A display apparatus comprising:

a display panel;

a correcting circuit configured to carry out a gamma correction on input gradation data in response to correction data which specifies a shape of a gamma curve to generate output gradation data;

a correction data storage section configured to receive and store said correction data, supplied externally, and to transfer the stored correction data to said correcting circuit; and a driving circuit configured to drive said display panel in response to said output gradation data from said correcting circuit, wherein said correcting circuit:

selects a correction calculation equation from among a plurality of correction calculation equations based on a value of said input gradation data and said correction data, the selected correction calculation equation including a parameter which is determined based on a maximum value of the input gradation data, and a coefficient which is determined based on said correction data; and carries out an approximation calculation for said gamma correction based on said input gradation data by using the selected correction calculation equation; and wherein said correction data comprises correction point data CP0 to CP5, if said input gradation data is $D_{IN}$, said output gradation data is $D_{OUT}$ and an intermediate data value $D_{IN}^{Center}$ is defined by a following equation (1) by using a permissible maximum value $D_{IN}^{MAX}$ of said input gradation data:

$$D_{IN}^{Center}=D_{IN}^{MAX}/2 \tag{1}$$

(1) when said correction point data CP0 to CP5 are determined for said input gradation data $D_{IN}$ to be smaller than said intermediate data value $D_{IN}^{Center}$ and for a gamma value of said gamma correction to be less than one, said output gradation data $D_{OUT}$ is calculated from the following equation (2a):

$$D_{OUT}=2(CP1-CP0)PD_{INS}/K^2+(CP3-CP0)D_{INS}/K+CP0 \tag{2a}$$

(2) said correction point data CP0 to CP5 are determined for said input gradation data $D_{IN}$ smaller than said intermediate data value $D_{IN}^{Center}$ and for a gamma value of said gamma correction to exceed one, said output gradation data $D_{OUT}$ is calculated from the following equation (2b):

$$D_{OUT}=2(CP1-CP0)ND_{INS}/K^2+(CP3-CP0)D_{INS}/K+CP0 \tag{2b}$$

(3) when said input gradation data $D_{IN}$ is larger than said intermediate data value $D_{IN}^{Center}$, said output gradation $D_{OUT}$ is calculated from the following equation (2c):

$$D_{OUT}=2(CP4-CP2)ND_{INS}/K^2+(CP5-CP2)D_{INS}/K+CP2 \tag{2c}$$

where when a parameter R is defined by the following equation:

$$R=K^{1/2}\cdot D_{INS}^{1/2},$$

said K, $D_{INS}$, $PD_{INS}$, and $ND_{INS}$ take values defined by the following equations:

$$K=(D_{IN}^{MAX}+1)/2,$$

$$D_{INS}=D_{IN} \text{ (in case of } D_{IN}<D_{IN}^{Center})$$

$$D_{INS}=D_{IN}+1-K \text{ (in case of } D_{IN}>D_{IN}^{Center})$$

$$PD_{INS}=(K-R)\cdot R$$

$$ND_{INS}=(K-D_{INS})\cdot D_{INS}.$$

2. The display apparatus according to claim 1, wherein a first calculation equation of said plurality of calculation equations has a term proportional to $D_{IN}^{n1}$ ($D_{IN}$ is said input gradation data and 0<n1<1) without having a term proportional to $D_{IN}^{n2}$ (n2>1), and a second calculation equation of said plurality of calculation equations has a term proportional to $D_{IN}^{n2}$ without having a term proportional to $D_{IN}^{n1}$.

3. The display apparatus according to claim 2, wherein said n1 is ½, and said n2 is 2.

4. The display apparatus according to claim 2, wherein said correction data is determined for a gamma value for said gamma correction to be less than one, and when said input gradation data is smaller than a predetermined value, said first calculation equation is selected as said correction calculation equation.

5. The display apparatus according to claim 4, wherein said correction data is determined for the gamma value for said gamma correction to exceed one, and said second calculation equation is selected as said correction calculation equation when said input gradation data is smaller than said predetermined value or when said input gradation data is larger than said predetermined value.

6. The display apparatus according to claim 2, wherein said first calculation equation is defined such that said output gradation data calculated through said gamma correction from said first calculation equation and said output gradation data calculated from an exact equation for the gamma correction are coincident with each other when said input gradation data is a value of a first value range, and said second calculation equation is defined such that said output gradation data calculated through said gamma correction from said second calculation equation and said output gradation data calculated from said exact equation of the gamma correction are coincident with each other, when said input gradation data is a value of a second value range, and said first value range is smaller than said second value range.

7. The display apparatus according to claim 1, wherein said correction point data CP0 to CP5 are calculated:

(1) from the following equation (3a) when the gamma value γ of said gamma correction is smaller than one, $$CP0$$

$$CP1=(4\mathrm{Gamma}[K/4]-\mathrm{Gamma}[K])/2$$

$$CP2=\mathrm{Gamma}[K-1]$$

$$CP3=\mathrm{Gamma}[K]$$

$$CP4=2\mathrm{Gamma}[(D_{IN}^{MAX}+K-1)/2]-D_{OUT}^{MAX}$$

$$CP5=D_{OUT}^{MAX} \quad (3a)$$

(2) from the following equation (3b) when said gamma value γ exceeds one:

$$CP0$$

$$CP1=2\mathrm{Gamma}[K/2]-\mathrm{Gamma}[K]$$

$$CP2=\mathrm{Gamma}[K-1]$$

$$CP3=\mathrm{Gamma}[K]$$

$$CP4=2\mathrm{Gamma}[(D_{IN}^{MAX}+K-1)/2]-D_{OUT}^{MAX}$$

$$CP5=D_{OUT}^{MAX} \quad (3b)$$

where Gamma[x] is a function defined by the following equation when $D_{OUT}^{MAX}$ is a maximum value of said output gradation data:

$$\mathrm{Gamma}[x]=D_{OUT}^{MAX}(x/D_{IN}^{MAX})^{\gamma} \quad (4).$$

8. The display apparatus according to claim 1, wherein said correcting circuit comprises:

an order switching circuit having a function to generate a first data value which depends on $D_{IN}^{n1}$ ($D_{IN}$ is said input gradation data and 0<n1<1) and a second data value which depends on $D_{IN}^{n2}$ (n2>1), and configured to output one of said first data value and said second data value; and an output gradation data calculating circuit configured to use said one of said first and second data values as a variable, and to generate said output gradation data by using a calculation equation whose coefficients are determined from correction data which specifies a shape of a gamma curve for the gamma correction.

9. The display apparatus according to claim 1, wherein the correcting circuit determines the coefficient for the correction calculation equation based on whether said correction data is greater than or less than, an intermediate data value.

10. The display apparatus according to claim 1, wherein said correcting circuit:

calculates a plurality of variables for the correction calculation equation; and selects a variable from the plurality of variables based on whether a gamma value of said gamma correction is greater than one and whether the input gradation value is greater than an intermediate data value.

11. The display apparatus according to claim 10, wherein said correcting circuit:

carries out the approximation calculation for said gamma correction using the correction calculation equation including the selected variable and the determined coefficient; and generates output gradation data based on the approximation calculation.

12. A controller driver comprising:

a correcting circuit configured to carry out gamma correction on input gradation data in response to correction data which specifies a shape of a gamma curve;

a correction data storage section configured to receive said correction data from outside said controller driver to store therein the received correction data, and to transfer the stored correction data to said correcting circuit; and a driving circuit configured to drive a display panel in response to output gradation data which is outputted from said correcting circuit, wherein said correcting circuit:

selects a correction calculation equation from among a plurality of correction calculation equations based on a value of said input gradation data and said correction data, the selected correction calculation equation including a parameter which is determined based on a maximum value of the input gradation data, and a coefficient which is determined based on said correction data; and uses said input gradation data as a variable and carries out approximation calculation of said gamma correction by using the selected correction calculation equation; and wherein said correction data comprises correction point data CP0 to CP5, if said input gradation data is $D_{IN}$, said output gradation data is $D_{OUT}$ and an intermediate data value $D_{IN}^{Center}$ is defined by a following equation (1) by using a permissible maximum value $D_{IN}^{MAX}$ of said input gradation data:

$$D_{IN}^{Center}=D_{IN}^{MAX}/2 \quad (1)$$

(1) when said correction point data CP0 to CP5 are determined for said input gradation data $D_{IN}$ to be smaller than said intermediate data value $D_{IN}^{Center}$ and for a gamma value of said gamma correction to be less than one, said output gradation data $D_{OUT}$ is calculated froth the following equation (2a):

$$D_{OUT}=2(CP1-CP0)PD_{INS}/K^2+(CP3-CP0)D_{INS}/K+CP0 \quad (2a)$$

(2) when said correction point data CP0 to CP5 are determined for said input gradation data $D_{IN}$ to be smaller than said intermediate data value $D_{IN}^{Center}$ and for a gamma value of said gamma correction to exceed one, said output gradation data $D_{OUT}$ is calculated from the following equation (2b):

$$D_{OUT}=2(CP1-CP0)ND_{INS}/K^2+(CP3-CP0)D_{INS}/K+CP0 \quad (2b)$$

(3) when said input gradation data $D_{IN}$ is larger than said intermediate data value $D_{IN}^{Center}$, said output gradation data $D_{OUT}$ is calculated from the following equation (2c):

$$D_{OUT}=2(CP4-CP2)ND_{INS}/K+CP2 \quad (2c)$$

where when a parameter R is defined by the following equation:

$$R=K^{1/2}\cdot D_{INS}^{1/2},$$

said K, $D_{INS}$, $PD_{INS}$, and $ND_{INS}$ take values defined by the following equations:

$$K=(D_{IN}^{MAX}+1)/2,$$

$$D_{INS}=D_{IN} \text{ (in case of } D_{IN}<D_{IN}^{Center})$$

$$D_{INS}=D_{IN}+1-K \text{ (in case of } D_{IN}>D_{IN}^{Center})$$

$$PD_{INS}=(K\cdot R)\cdot R$$

$$ND_{INS}=(K-D_{INS})\cdot D_{INS}.$$

13. The controller driver according to claim 12, wherein a first calculation equation of said plurality of calculation equations has a term proportional to $D_{IN}^{n1}$ ($D_{IN}$ is said input gradation data and 0<n1<1) without having a term proportional to $D_{IN}^{n2}$ (n2>1), and a second calculation equation of said plurality of calculation equations has a term proportional to $D_{IN}^{n2}$ without having a term proportional to $D_{IN}^{n1}$.

14. The controller driver according to claim 13, wherein said correction data is determined for a gamma value of said gamma correction to be less than one, and when said input gradation data is smaller than a predetermined value, said first calculation equation is selected as said correction calculation equation.

15. The controller driver according to claim 12, wherein said correcting circuit comprises:

an order switching circuit having a function to generate a first data value which depends on $D_{IN}^{n1}$ ($D_{IN}$ is said input gradation data and 0<n1<1) and a second data value which depends on $D_{IN}^{n2}$ (n2>1) in response to said input gradation data, and configured to output one of said first and second data values; and an output gradation data calculating circuit configured to use said one data value outputted from said order switching circuit as a variable and to generate said output gradation data by using a calculation equation whose coefficients are determined from said correction data which specifies a shape of gamma curve for said gamma correction.

16. A method of driving a display panel, comprising:

generating output gradation data from input gradation data by:

selecting a correction calculation equation from among a plurality of correction calculation equations based on a value of said input gradation data and a value of correction, data which specifies a shape of a gamma curve, the selected correction calculation equation including a parameter which is determined based on a maximum value of the input gradation data, and a coefficient which is determined based on the correction data; and carrying out an approximation of gamma correction on the input gradation data by using the selected correction calculation equation; and driving a display panel in response to said output gradation data; and wherein said correction data comprises correction point data CP0 to CP5, if said input gradation data is $D_{IN}$, said output gradation data is $D_{OUT}$ and an intermediate data value $D_{IN}^{Center}$ is defined by a following equation (1) by using a permissible maximum value $D_{IN}^{MAX}$ of said input gradation data:

$$D_{IN}^{Center}=D_{IN}^{MAX}/2 \quad (1)$$

(1) when said correction point data CP0 to CP5 are determined for said input gradation data $D_{IN}$ to be smaller than said intermediate data value $D_{IN}^{Center}$ and for a gamma value of said gamma correction to be less than one, said output gradation data $D_{OUT}$ is calculated from the following equation (2a):

$$D_{OUT}=2(CP1-CP0)PD_{INS}/K^2+(CP3-CP0)D_{INS}/K+CP0 \quad (2a)$$

(2) when said correction point data CP0 to CP5 are determined for said input gradation data $D_{IN}$ to be smaller than said intermediate data value $D_{IN}^{Center}$ and for a gamma value of said gamma correction to exceed one, said output gradation data $D_{OUT}$ is calculated from the following equation (2b):

$$D_{OUT}=2(CP1-CP0)ND_{INS}/K^2+(CP3-CP0)D_{INS}/K+CP0 \quad (2b)$$

(3) when said input gradation data $D_{IN}$ is larger than said intermediate data value $D_{IN}^{Center}$, said output gradation data $D_{OUT}$ is calculated from the following equation (2c):

$$D_{OUT}=2(CP4-CP2)ND_{INS}/K^2+(CP5-CP2)D_{INS}/K+CP2 \quad (2c)$$

where when a parameter R is defined by the following equation:

$$R=K^{1/2}\cdot D_{INS}^{1/2},$$

said K, $D_{INS}$, $PD_{INS}$, and $ND_{INS}$ take values defined by the following equations:

$$K=(D_{IN}^{MAX}+1)/2$$

$$D_{INS}=D_{IN} \text{ (in case of } D_{IN}<D_{IN}^{Center})$$

$$D_{INS}=D_{IN}+1-K \text{ (in case of } D_{IN}>D_{IN}^{Center})$$

$$PD_{INS}=(K-R)\cdot R$$

$$ND_{INS}=(K-D_{INS})\cdot D_{INS}.$$

17. A display apparatus comprising:

a display panel;

a correcting circuit configured to carry out a gamma correction on input gradation data in response to correction data which specifies a shape of a gamma curve to generate output gradation data;

a correction data storage section configured to receive and store said correction data, supplied externally, and to transfer the stored correction data to said correcting circuit; and a driving circuit configured to drive said display panel in response to said output gradation data from said correcting circuit, wherein said correcting circuit:

selects a correction calculation equation from among a plurality of correction calculation equations based on a value of said input gradation data and said correction data, the selected correction calculation equation including a parameter which is determined based on a maximum value of the input gradation data, and a coefficient which is determined based on said correction data; and carries out an approximation, calculation for said gamma correction based on said input gradation data by using the selected correction calculation equation; and said correction calculation equation is of a form:

$$D_{OUT} = \frac{B \cdot D_{IN}^{sel}}{(K^2/2)} + \frac{C \cdot D_{INS}}{K} + A,$$

wherein:

$D_{OUT}$ represents output gradation data, $D_{IN}$ represents input gradation data, $D_{IN}^{MAX}$ represents a maximum value of $D_{IN}$, $K=(D_{IN}^{MAX}+1)/2$, $D_{INS}=D_{IN}$ if a most significant bit of $D_{IN}$ is 0, $D_{INS}=D_{IN}+1-K$ if a most significant bit of $D_{IN}$ is 1, and values of A, B, C, and $D_{IN}^{se1}$ are determined according to said input gradation data and said correction data.

* * * * *

UNITED STATES PATENT AND TRADEMARK OFFICE

CERTIFICATE OF CORRECTION

PATENT NO. : 8,009,180 B2
APPLICATION NO. : 11/515037
DATED : August 30, 2011
INVENTOR(S) : Takashi Nose et al.

It is certified that error appears in the above-identified patent and that said Letters Patent is hereby corrected as shown below:

Title Page, Item (73) Assignee replace "Renesas Electornics Corporation" with "Renesas Electronics Corporation".

Signed and Sealed this
Twenty-ninth Day of November, 2011

David J. Kappos

David J. Kappos
*Director of the United States Patent and Trademark Office*